US011312916B2

(12) United States Patent
Seemeyer et al.

(10) Patent No.: US 11,312,916 B2
(45) Date of Patent: Apr. 26, 2022

(54) LUBRICANT COMPOSITION CONTAINING IONIC LIQUIDS

(71) Applicant: Klüber Lubrication München SE & Co. KG, Munich (DE)

(72) Inventors: Stefan Seemeyer, Wolfratshausen (DE); Stefan Grundei, Mering (DE); Nataliya Panagiotidou, Munich (DE); Thomas Schubert, Bad Wimpfen (DE); Sebastian Plebst, Ludwigsburg (DE)

(73) Assignee: Klüber Lubrication München SE & Co. KG, Munich (DE)

( * ) Notice: Subject to any disclaimer, the term of this patent is extended or adjusted under 35 U.S.C. 154(b) by 0 days.

(21) Appl. No.: 17/161,932

(22) Filed: Jan. 29, 2021

(65) Prior Publication Data

US 2021/0253972 A1 Aug. 19, 2021

(30) Foreign Application Priority Data

Jan. 31, 2020 (DE) ..... 10 2020 102 462.2

(51) Int. Cl.

| | |
|---|---|
| ***C10M 137/12*** | (2006.01) |
| ***C10M 101/02*** | (2006.01) |
| ***C10M 105/34*** | (2006.01) |
| ***C10M 107/10*** | (2006.01) |
| ***C10M 133/16*** | (2006.01) |
| ***C10M 137/10*** | (2006.01) |
| ***C10M 169/04*** | (2006.01) |
| *C10N 40/00* | (2006.01) |
| *C10N 30/06* | (2006.01) |
| *C10N 40/02* | (2006.01) |
| *C10N 40/04* | (2006.01) |
| *C10N 50/10* | (2006.01) |

(52) U.S. Cl.

CPC ..... *C10M 137/12* (2013.01); *C10M 101/02* (2013.01); *C10M 105/34* (2013.01); *C10M 107/10* (2013.01); *C10M 133/16* (2013.01); *C10M 137/105* (2013.01); *C10M 169/04* (2013.01); *C10M 2205/0285* (2013.01); *C10M 2209/043* (2013.01); *C10M 2215/086* (2013.01); *C10M 2223/047* (2013.01); *C10N 2030/06* (2013.01); *C10N 2040/02* (2013.01); *C10N 2040/04* (2013.01); *C10N 2040/38* (2020.05); *C10N 2050/10* (2013.01)

(58) Field of Classification Search

CPC ..... C10M 137/12; C10M 101/02; C10M 105/34; C10M 107/10; C10M 133/16; C10M 137/105; C10M 169/04; C10M 2205/0285; C10M 2209/043; C10M 2215/086; C10M 2223/047; C10N 2030/06; C10N 2040/02; C10N 2040/04; C10N 2040/38

See application file for complete search history.

(56) References Cited

U.S. PATENT DOCUMENTS

| | | | | |
|---|---|---|---|---|
| 2010/0105586 | A1 | 4/2010 | Bodesheim et al. | |
| 2010/0227783 | A1* | 9/2010 | Habeeb | C10M 171/00 508/262 |
| 2012/0202724 | A1 | 8/2012 | Bodesheim et al. | |
| 2013/0331305 | A1* | 12/2013 | Aswath | C10M 141/10 508/388 |
| 2014/0171348 | A1* | 6/2014 | Patil | C10M 111/04 508/284 |
| 2015/0045266 | A1* | 2/2015 | Patil | C10M 171/00 508/283 |
| 2015/0232777 | A1 | 8/2015 | Qu et al. | |
| 2016/0024421 | A1 | 1/2016 | Qu et al. | |
| 2021/0087490 | A1* | 3/2021 | Shin | C07F 9/11 |

FOREIGN PATENT DOCUMENTS

| | | |
|---|---|---|
| EP | 1970432 A1 | 9/2008 |
| EP | 2164934 B1 | 7/2018 |

OTHER PUBLICATIONS

Barnhill, C. et al., Tertiary and Quarternary Ammonium-Phosphate Ionic Liquids as lubricant Additives, Tribology letters, 63:22, 2016.
Somers, A. et al., Appl. Mater. Interfaces, 5:11544-11553, 2013.

* cited by examiner

*Primary Examiner* — Ellen M McAvoy
(74) *Attorney, Agent, or Firm* — Dinsmore & Shohl LLP; Weston R. Gould

(57) ABSTRACT

The present disclosure relates to a lubricant composition comprising a lubricant, a first ionic liquid which is soluble in polyalphaolefin and a second ionic liquid which is insoluble in polyalphaolefin. By using the two different ionic liquids, the technical properties of the lubricant compositions can be improved.

17 Claims, No Drawings

LUBRICANT COMPOSITION CONTAINING IONIC LIQUIDS

REFERENCE TO RELATED APPLICATION

This application claims priority to German Patent Application No. 10 2020 102 462.2, filed Jan. 31, 2020, the entire content of which is incorporated herein by reference.

FIELD

The present disclosure relates to a lubricant composition containing ionic liquids and its use.

BACKGROUND

It is known that ionic liquids can be used as additives in lubricants, such as greases and lubricating oils. Thus, tribologically relevant properties such as friction, wear and electrical conductivity, can be favourably influenced. However, the disadvantage is that in lubricants which predominantly contain base oils or base oil mixtures with low polarity ionic liquids are not soluble or are only soluble to a very limited extent.

EP2164934B1 describes the use of selected ionic liquids (IL) with fluorine-containing anions in lubricant compositions to reduce the ageing phenomena of the lubricant and to reduce the electrical resistance of the lubricant. The ionic liquids described therein are particularly suitable for polar base oils such as esters and polyglycols. Based on this publication, it would be desirable to extend this effect to lubricants based on base oils or base oil mixtures with low polarity.

A. E. Somers et al., Appl. Mater. Interfaces 2013, 5, 11544-11553 (dx.doi.org/10.1021/am4037614) describes the use of ionic liquids as a wear-reducing additive in basic oils. Here, the influence of the structure on the miscibility and the wear protection effect when used as a lubricant for steel on aluminium is investigated. In summary, mixtures of non-polar basic oils and IL were able to withstand higher wear test loads than mixtures of polar base oils and IL, wherein the best results were achieved with mixtures of mineral oil with IL with ($^iC_8$)phosphinate cation.

William C. Barnhill, Huimin Luo, Harry M. Meyer III, Cheng Ma, Miaffang Chi, Brian L. Papke and Jun Qu describe in Tertiary and quarternary Ammonium-Phosphate Ionic Liquids as lubricant additives, Tribology letters (2016) 63:22, DOI 10.1007/s11249-016-0707-6 the solubility and friction and wear properties of e.g. trioctylmethylammonium bis(2-ethylhexyl)phosphate (abbreviation N1888 dehp) and trioctylammonium bis(2-ethylhexyl)phosphate (N888H dehp) in a model engine oil.

EP1970432A1 describes IL with ammonium or phosphonium cations, combined with a large number of anions as additives in lubricants, especially for internal combustion engines.

US20160024421A1 describes IL with quaternary phosphonium cations, combined with branched carboxylate anions, which should show improved solubility in non-polar oils.

US20150232777A1 describes IL with symmetrical phosphonium cations, combined with phosphate anions as substances and as additives for lubricants for reducing friction and wear.

Although the ionic liquids with phosphate and carboxylate anions specified in the four documents mentioned above show an improved solubility in lubricants containing predominantly base oils with low polarity, only a slight reduction in electrical resistance is shown.

SUMMARY

The object of the present disclosure is to provide lubricant compositions that show a reduced electrical resistance even if they comprise basic oils with low polarity.

This object is achieved by a lubricant composition comprising:

a) a lubricant, in particular containing a non-polar basic oil,
b) a first ionic liquid soluble in polyalphaolefin, in particular in PAO 400/40, prepared from 1-decene as a monomer component,
c) a second ionic liquid insoluble in polyalphaolefin, in particular in PAO 400/40, prepared from 1-decene as a monomer component.

DETAILED DESCRIPTION

An embodiment as provide herein is a lubricant composition comprising:

a) a lubricant containing a non-polar basic oil,
b) a first ionic liquid soluble in polyalphaolefin (PAO) 400/40, prepared from 1-decene as a monomer component,
c) a second ionic liquid insoluble in polyalphaolefin (PAO) 400/40, prepared from 1-decene as a monomer component.

In the context of this disclosure, the term "lubricant" means a composition comprising a basic oil and optionally at least one additive. Suitable additives are specified below. Optionally, the additive is selected from corrosion inhibitors, antioxidants, agents for protection against metal influences, radical scavengers, UV stabilisers, reaction layer formers, friction inhibitors, rheology modifiers, solid lubricants and mixtures thereof.

Suitable basic oils are optionally synthetic oils, mineral oils, native oils or mixtures thereof. The basic oil can include or consist of a single base oil (wherein the terms are then synonymous) or contain two or more base oils.

According to this disclosure, the lubricant optionally contains a non-polar basic oil.

In the context of this disclosure, a non-polar basic oil is understood to be a basic oil with a dipole moment of at most 3.00 D. The dipole moments of the basic oils can be calculated according to the method described in A. Naveira Suárez, M. Grahn, R. Pasaribu and R. Larsson, The influence of base oil polarity on the tribological performance of zinc dialkyl dithiophosphate additives, Tribology International, 2010, 43 (12), pages 2268-2278.

Polyalphaolefins are commercially available and can be produced catalytically from ethylene according to known methods, wherein initially alphaolefins with longer chain length are obtained as an intermediate. From this, polyalphaolefins are synthesized substantially by oligomerization, wherein usually isoparaffins with a varying number of side chains of equal length are obtained. Synthesis can be performed by acid-catalyzed (conventional) or metallocene-catalyzed olefin polymerisation. Conventional PAO and metallocene-catalyzed PAO differ in their structure and the resulting product properties. Conventional PAO products show a high degree of isomerization resulting from ionic oligomerization under formation of charged intermediates that readily undergo carbocation rearrangement. In the metallocene oligomerization the olefin is inserted into a metal-carbon-bond without the formation of charged intermediates and the resulting products are free from isomerization. Suitable polyalphaolefins are e.g. the oligomers, preferably the dimers, trimers, tetramers, pentamers and higher oligomers with more than 5 repeating units of alphaolefins, and mixtures of these oligomers. The alphaolefins used for the preparation of polyalphaolefins are preferably selected from $C_8$-$C_{14}$ alphaolefins, in particular 1-octene, 1-decene, 1-dodecene and mixtures thereof. In a preferred embodiment, 1-decene and 1-decene-containing alphaolefin mixtures are used for the production of polyalphaolefins. Technically available polyalphaolefins are usually present in the form of a mixture. By way of example, a typical decene dimer can contain 80 to 99.8% by weight of decene dimer, 0.1 to 19.8% by weight of decene monomer and 0.1 to 19.8% by weight of decene trimer. It is also possible to use polyalphaolefin copolymers and polylalphaolefin mixtures from alphaolefins with different numbers of carbon atoms, e.g. decene/dodecene copolymers or mixtures of decene homopolymers and dodecene homopolymers. By selecting suitable compositions of these copolymers and mixtures, the properties of the polyalphaolefins can be adjusted over a wide range depending on the respective requirements.

PAO 400/40, which is used as a basic oil and for determining the solubility of ionic liquids according to the disclosure, is commercially available, e.g. under the name Synton® PAO 40 by the company Lanxess. PAO 400/40 is a polyalphaolefin with a kinematic viscosity of 40 $mm^2/s$ (=40 cSt) at 100° C. The measuring accuracy is +/−5%, for mineral oils+/−10%.

An ionic liquid is soluble in polyalphaolefin, in particular in PAO 400/40 prepared from 1-decene as a monomer component, if during a turbidity measurement according to DIN EN ISO 7027 of a mixture of 1% by weight of the ionic liquid and 99% by weight of polyalphaolefin, in particular PAO 400/40, prepared from 1-decene as monomer components, at 25° C., the turbidity value is not more than 1 FNU higher than with pure polyalphaolefin, in particular PAO 400/40, prepared from 1-decene as a monomer component. Polyalphaolefin was used as a reference because it is a non-polar basic oil with very low turbidity.

An ionic liquid is insoluble in polyalphaolefin, in particular in PAO 400/40 prepared from 1-decene as a monomer component, if during a turbidity measurement according to DIN EN ISO 7027 of a mixture of 1% by weight of the ionic liquid and 99% by weight of polyalphaolefin, in particular PAO 400/40 prepared from 1-decene as a monomer component, at 25° C., the turbidity value is more than 1 FNU higher than with pure polyalphaolefin, in particular PAO 400/40 prepared from 1-decene as a monomer component.

Surprisingly, it was found that the combination of a lubricant with a first ionic liquid soluble in polyalphaolefin and a second ionic liquid insoluble in polyalphaolefin leads to a higher solubility of the second ionic liquid and shows a disproportionate reduction of the electrical resistance of the lubricant composition. This applies in particular to lubricant compositions which contain a non-polar basic oil.

Without specifying a mechanism, it is assumed that, in lubricant compositions containing a non-polar basic oil, this leads to an improvement in the mobility of the charge carriers, such that in the second ionic liquid, due to its chemical nature, the charge carriers are less strongly bonded to each other. As a result, the increase in solubility caused by the combination with the first ionic liquid results in a stronger reduction of the electrical resistance in the non-polar basic oil. In addition, it is assumed that the improved solubility of the second ionic liquid is due to interaction with the first ionic liquid in the non-polar basic oil.

In a preferred embodiment of the disclosure, the first ionic liquid is soluble in the preferably non-polar basic oil contained in the lubricant composition and the second ionic liquid is insoluble in this basic oil. Here, the solubility of the ionic liquid in the basic oil is determined analogously to the method described in the chapter Testing Methods, wherein the respective base oil contained in the lubricant composition is taken as reference.

The increase in the solubility of the second ionic liquid was unexpected, since non-polar basic oils usually only have a limited absorption capacity for ionic substances, and salting-out effects are observed when the concentration of ionic substances is increased.

Furthermore, this changed solubility behaviour also has a positive effect on other lubricant properties such as friction and wear behaviour of the lubricant composition.

In accordance with the disclosure, the lubricant composition comprises a basic oil, preferably a non-polar basic oil.

The basic oil can consist of a base oil selected from synthetic oils, mineral oils and native oils, or can contain a combination of synthetic oils, mineral oils and/or native oils as base oils. These oils can be used individually or in any combination depending on the application.

Synthetic base oils comprise esters of an aliphatic or aromatic di-, tri- or tetracarboxylic acid with one or more $C_7$ to $C_{22}$ alcohols present in the mixture, furthermore esters of trimethylolpropane, pentaerythritol or dipentaerythritol with aliphatic $C_7$ to $C_{22}$ carboxylic acids, Cis dimer acid esters with $C_7$ to $C_{22}$ alcohols, as well as complex esters and estolides. Also suitable as synthetic base oils are polyalphaolefins (PAO). These can be produced by acid catalysis or metallocene catalysis as mentioned above. Also suitable as synthetic base oils are alkylated naphthalenes, alkylated benzenes, polyglycols, silicone oils, perfluoropolyethers, polyphenylethers, alkylated di- or triphenylethers and mixtures thereof. Further suitable as synthetic base oils are copolymers of LAO (linear alphaolefins) with unsaturated esters.

The mineral oils can be selected from paraffinic, naphthenic and aromatic hydrocrack oils as well as gas to liquid (GTL) liquids. GTL describes a method for producing liquid hydrocarbons from natural gas. As native oils, triglycerides from animal/plant sources can be used, which have been refined by known processes such as hydrogenation. The triglyceride oils that are particularly preferred are triglyceride oils with high oleic acid content. Typical vegetable oils with a high oleic acid content used herein are safflower oil, corn oil, rapeseed oil, sunflower oil, soybean oil, linseed oil, peanut oil, lesquerella oil, meadowfoam oil and palm oil.

Optionally, the basic oil has a first base oil selected from the group consisting of mineral oils, PAO, diphenyl ethers and mixtures thereof in combination with a second base oil selected from the group consisting of native and synthetic esters, polyglycols and mixtures thereof. Preferably, the weight ratio of the first base oil to the second base oil is 90:10 to 50:50, particularly preferably 85:15 to 60:40, in particular 80:20 to 70:30.

Also optionally, the basic oil has a base oil selected from the group consisting of mineral oils, polyalphaolefins, alkylated naphthalenes, alkylated diphenyl ethers, alkylated benzenes, copolymers of alkenes, particularly linear alphaolefins (LAO) with unsaturated esters, and mixtures thereof. In particular, the basic oil has a base oil selected from the group consisting of polyalphaolefins and alkylated diphenyl ethers and their mixtures.

Also optionally, the basic oil has a base oil selected from the group consisting of copolymers of alkenes, preferably LAOs with unsaturated esters and mixtures thereof. Particularly preferably, the basic oil has, as a base oil, a copolymer of decene and/or dodecene and dec-9-enecarboxylic acid methyl ester, in particular Elevance Aria WTP 40©, and/or mixtures thereof.

In accordance with this disclosure, non-polar basic oils optionally contain a non-polar base oil, selected from the group consisting of mineral oils, polyalphaolefins, alkylated naphthalenes, alkylated diphenyl ethers, alkylates benzenes, copolymers of alkenes, in particular LAO (linear alphaolefins) with unsaturated esters, in particular a copolymer of decene and dec-9-enecarboxylic acid methyl ester and mixtures thereof. Non-polar basic oils also preferred according to the disclosure contain a non-polar base oil, in particular one or more of the above-mentioned non-polar base oils, in a mixture with other base oils, in particular with polar base oils, preferably esters and polyglycols, i.e. base oils with a calculated dipole moment of more than 3.00 D. Then the non-polar base oil is optionally present in a proportion of more than 50% by weight, optionally in a proportion of more than 60% by weight, in particular in a proportion of more than 70% by weight, with regard to the total weight of the basic oil. In a special embodiment, the non-polar base oil is present in a proportion of 50 to 90% by weight, more preferably in a proportion of 60 to 85% by weight, in particular in a proportion of 70 to 85% by weight, with regard to the total weight of the basic oil.

In accordance with this disclosure, the first ionic liquid optionally has anions selected from dialkyl phosphate, dialkyl phosphinate, carboxylate and mixtures thereof. Particularly preferably, the first ionic liquid has anions selected from the group consisting of bis(2-ethylhexyl)phosphate, bis(2,4,4-trimethylpentyl)phosphinate, decanoate, docusate and mixtures thereof. Docusate denotes the anion bis(2-ethylhexyl) sulfosuccinate.

Optionally, the second ionic liquid has anions selected from bis(perfluoroalkylsulfonyl)imides, tris(perfluoroalkylsulfonyl)methides, tris(perfluoralkyl)trifluorophosphates, bis(fluorosulfonyl)imide and mixtures thereof. In a specific embodiment, the second ionic liquid has anions selected from bis(perfluoroalkylsulfonyl)imides, tris(perfluoroalkylsulfonyl)methides, tris(perfluoralkyl)trifluorophosphates and mixtures thereof.

The second ionic liquid optionally has anions selected from the group consisting of bis(trifluoroalkyl sulfonyl) imide, tris(trifluoroalkyl sulfonyl)methide, tris(pentafluoroethyl)trifluorophosphate, bis(fluorosulfonyl)imide and mixtures thereof. In a specific embodiment, the second ionic liquid has anions selected from the group consisting of bis(trifluoromethyl sulfonyl)imide, tris(trifluoromethyl sulfonyl)methide, tris(pentafluoroethyl)trifluorophosphate and mixtures thereof. Particularly preferred, the anion of the second ionic liquid is bis(trifluoromethylsulfonyl)imide (bta).

Optionally, the second ionic liquid has, as an anion, bis(fluorosulfonyl)imide or a mixture containing bis(fluorosulfonyl)imide. In a specific embodiment, the second ionic liquid has bis(fluorosulfonyl)imide as the sole anion. In a further specific embodiment, the second ionic liquid has, as an anion, a mixture of bis(fluorosulfonyl)imide and at least one other anion selected from bis(perfluoroalkyl sufonyl) imides, tris(perfluoroalkyl sulfonyl)methides, tris(perfluoroalkyl)trifluorophosphates and mixtures thereof.

Optionally, the first and second ionic liquids independently contain cations selected from the group of symmetrical and asymmetrical ammonium ions $NR_1R_2R_3R_4^+$ and phosphonium ions $PR_1R_2R_3R_4^+$. The radicals $R_1$ to $R_4$ are independently of each other branched or unbranched, substituted or unsubstituted $C_1$ to $C_{24}$ alkyl groups, optionally $C_1$ to $C_{18}$ alkyl groups, optionally $C_6$ to $C_{18}$ alkyl groups or substituted or unsubstituted $C_6$ to $C_{30}$ aryl groups. Preferred substituents are alkoxy, carboxy, amido, amino, thiocarboxy, carbamoyl, oxo, thioxo and/or hydroxy.

Optionally, the radicals $R_1$ to $R_4$ are selected such that they have a total of at least 10 carbon atoms, preferably at least 20 carbon atoms, even more preferably at least 25 carbon atoms.

Optionally, the first ionic liquid is selected from the group consisting of:

(trihexyltetradecylphosphonium) bis(2-ethylhexylphosphate) (P66614 dehp), available from the company IoLiTec with the product number IN-0036-HP

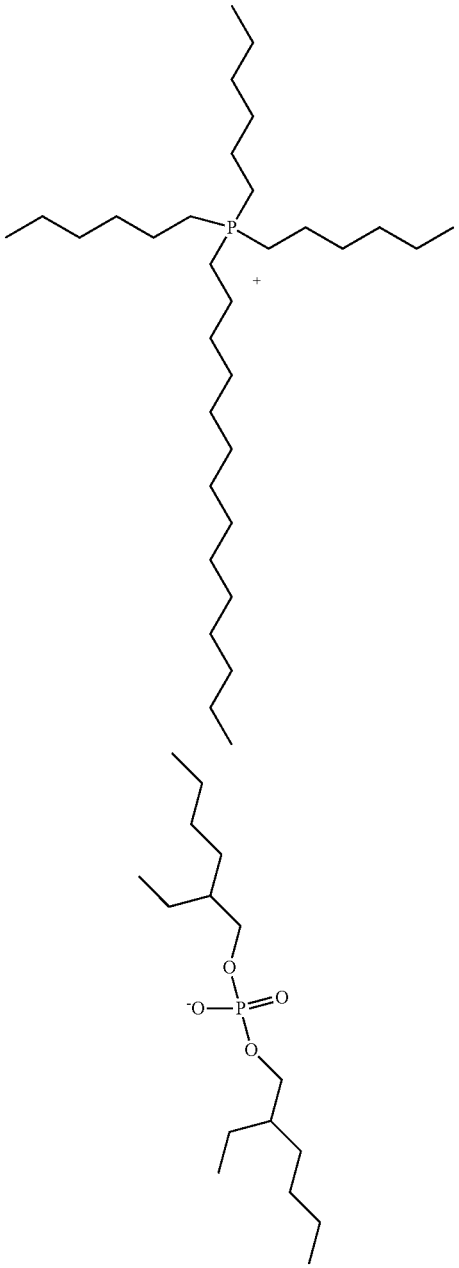

(trihexyltetradecylphosphonium) docusate, (P66614 docusate), available from the company IoLiTec with the product number IN-0042-HP

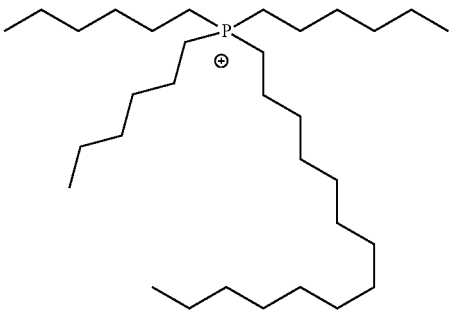

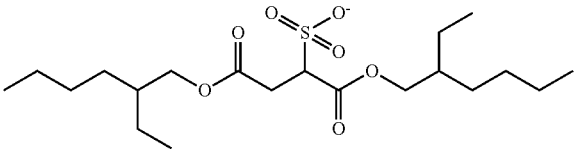

(trihexyltetradecylphosphonium) bis(2,4,4-trimethylpentyl)phosphinate (P66614 phosphinate) available from the company IoLiTec with the product number IN-0009-TG

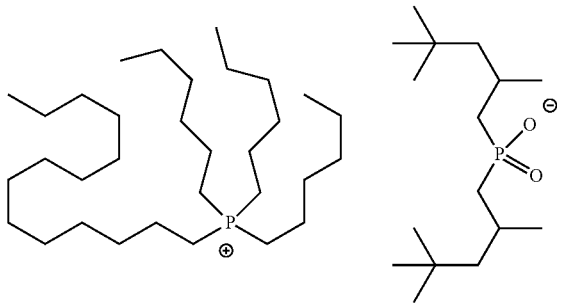

(trihexyltetradecylphosphonium) decanoate (P66614 decanoate), available from the company IoLiTec with the product number IN-0008-TG

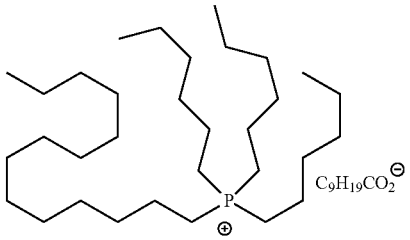

and mixtures thereof.

Optionally, the second ionic liquid is selected from the group consisting of:

(trihexyltetradecylphosphonium) bis(trifluormethylsulfonyl)imide (P66614 bta), available from the company IoLiTec with the product number IN-0021-HP

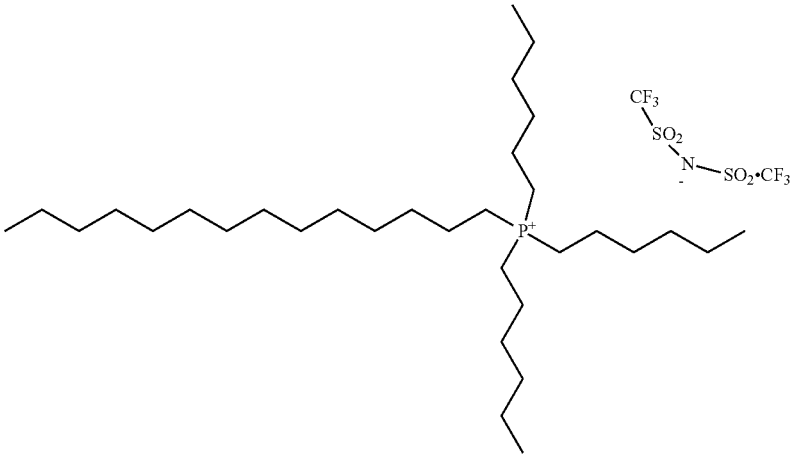

(tetraoctylphosphonium) bis(trifluormethylsulfonyl) imide (P8888 bta), available from the company IoLiTec with the product number IN-0043-HP

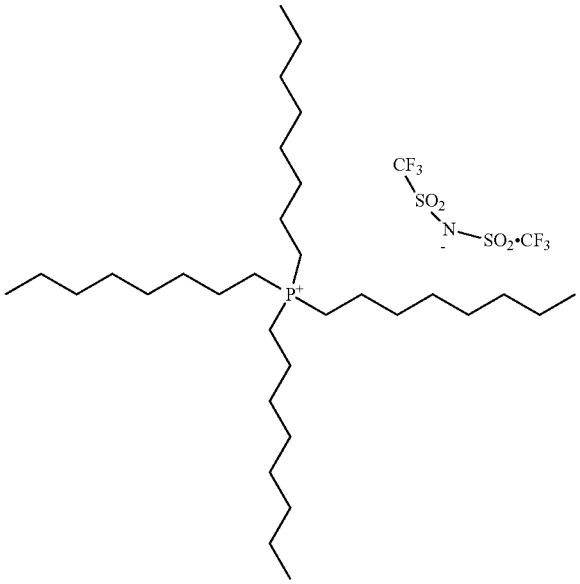

(methyltrioctylammonium) bis(trifluormethylsulfonyl) imide (N1888 bta), available from the company IoLiTec with the product number IL-0017-HP IL-0017-HP,

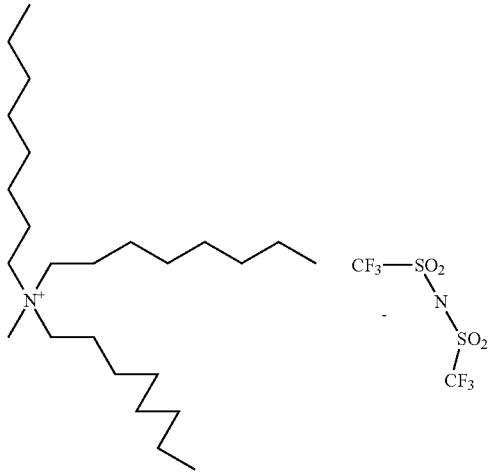

(trihexyltetradecylphosphonium) bis(fluorsulfonyl)imide (P66614 fsi), available from the company IoLiTec,

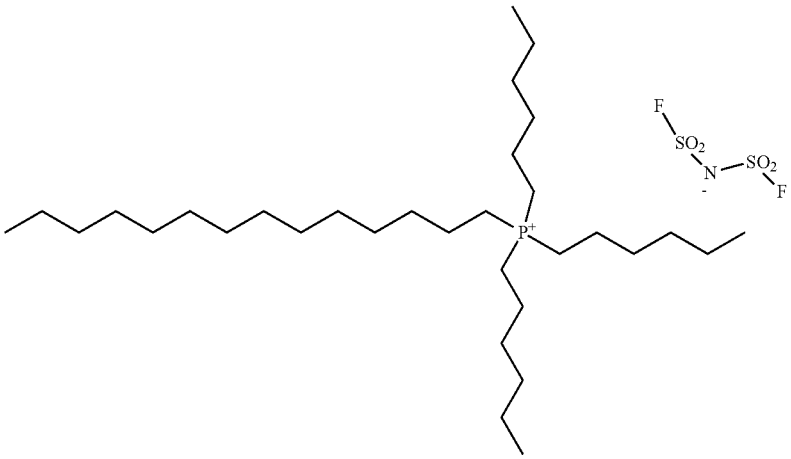

and mixtures thereof.

In a specific embodiment, the second ionic liquid is selected from (trihexyltetradecylphosphonium) bis(trifluormethylsulfonyl)imide, (tetraoctylphosphonium) bis(trifluormethylsulfonyl)imide, (methyltrioctylammonium) bis(trifluormethylsulfonyl)imide and mixtures thereof.

Particularly preferred is the combination of (trihexyltetradecylphosphonium) bis(2-ethylhexylphosphate) (P66614 dehp) as the first ionic liquid with (tetraoctylphosphonium) bis(trifluormethylsulfonyl)imide (P8888 bta) as the second ionic liquid.

Also particularly preferred is the combination of (trihexyltetradecylphosphonium) bis(2-ethylhexylphosphate) (P66614 dehp) as the first ionic liquid with (trihexyltetradecylphosphonium) bis(trifluormethylsulfonyl)imide (P66614 bta) as the second ionic liquid.

Also particularly preferred is the combination of (trihexyltetradecylphosphonium) bis(2-ethylhexylphosphate) (P66614 dehp) as the first ionic liquid with (trihexyltetradecylphosphonium) bis(fluorsulfonyl)imide (P66614 fsi) as the second ionic liquid.

In a preferred embodiment, the proportion of the first ionic liquid, with regard to the total weight of the lubricant composition, is 0.5% to 10% by weight, more preferably 1 to 5% by weight, in particular 2 to 5% by weight.

In a further preferred embodiment, the proportion of the second ionic liquid, with regard to the total weight of the lubricant composition, is 0.25% to 5% by weight, more preferably 0.5 to 2.5% by weight, in particular 1 to 2.5% by weight.

The weight ratio of the first ionic liquid to the second ionic liquid is preferably 1:1 to 4:1, more preferably 1.5:1 to 3:1, more preferably 1.5:1 to 2.5:1, in particular 1.9:1 to 2.1:1.

Preferably, the proportion of the lubricant with regard to the total weight of the lubricant composition is 99.25% by weight to 80% by weight, preferably 99.25% by weight to 85% by weight.

In addition, the lubricant can contain additional additives against corrosion, oxidation and for protection against metal influences, for example chelate compounds, radical scavengers, UV stabilisers, reaction layer formers. Preferably, additives in the form of phosphorous and sulphur-containing compounds, e.g. zinc dialkyldithiophosphate, are used as anti-wear/extreme pressure additives. Aromatic amines or substituted phenols can be used as antioxidants. Metal salts, carboxylic acids, esters, nitrogenous compounds and heterocyclic compounds can be used as agents for corrosion prevention, glycerol monoesters- or glycerol diesters can be used as friction inhibitors, and polyisobutylene, polymethacrylate and olefin copolymers can be used as viscosity improvers.

The lubricant can also contain a thickener. Thus, the lubricant is in the form of a lubricating grease. Preferably, the thickener is selected from urea, aluminium complex soaps, simple metal soaps of the elements of the $1^{st}$ and $2^{nd}$ main group of the periodic table, complex metal soaps of the elements of the $1^{st}$ and $2^{nd}$ main group of the periodic table, bentonite, sulfonate, silicate, polyimide or PTFE as well as a mixture of the aforementioned thickeners. In the case of urea thickeners, a reaction product of a diisocyanate, preferably 2,4-diisocyanatotoluolene, 2,6-diisocyanatotoluolene, 4,4'-diisocyanatodiphenylmethane 2,4'-diisocyantodiphenylmethane, 4,4'-diisocyanatodiphenyl, 4,4'-diisocyanato-3,3'-dimethyldiphenyl, 4,4'-diisocyanato-3,3'-dimethylphenylmethane, which can be used individually or in combination, with an amine/diamine of the general formula $(H_2N)_xR$, wherein x=1 or 2, and R is an aryl, alkyl or alkylene radical having from 2 to 22 carbon atoms, which are present individually or in combination, is employed.

The lubricant can also contain inorganic or organic solid lubricants. Preferred solid lubricants are selected from the group consisting of polytetrafluoroethylene (PTFE), molybdenum disulphide, graphite, graphene, boron nitride (hexagonal), tin (IV) sulphide, zinc (II) sulphide, tungsten sulphide, metal sulphide, phosphate such as calcium phosphate, carbonate such as calcium carbonate, metal oxide such as amorphous silicon dioxide, silicate and layered silicate, talc, mica and mixtures thereof.

A further subject matter of the present disclosure comprises a lubricant composition comprising:

a) a lubricant containing a basic oil selected from the group consisting of mineral oils, polyalphaolefins, alkylated naphthalenes, alkylated diphenyl ethers, alkylated benzenes, copolymers of alkenes and mixtures thereof, b) a first ionic liquid whose anion is selected from the group consisting of dialkyl phosphate, dialkyl phosphinate, carboxylate and mixtures thereof, c) a second ionic liquid whose anion is selected from the group consisting of bis(perfluoroalkylsulfonyl)imide, tris(perfluoroalkylsulfonyl)methide, tris(perfluoroalkyl)trifluorophosphate, bisfluorosulfonylimide and mixtures thereof.

In a specific embodiment, the lubricant contains a) as a basic oil, a copolymer of alkenes selected from LAOs with unsaturated esters and mixtures thereof. In another specific embodiment, the lubricant contains a) a basic oil selected from polyalphaolefins, alkylated diphenyl ethers and mixtures thereof.

In a specific embodiment, the first ionic liquid b) has anions selected from the group consisting of bis(2-ethylhexyl)phosphate, bis(2,4,4-trimethylpentyl)phosphinate, decanoate, docusate and mixtures thereof.

In a specific embodiment, the second ionic liquid c) has anions selected from the group consisting of bis(perfluoroalkylsulfonyl)imide, tris(perfluoroalkylsulfonyl)methide, tris(perfluoroalkyl)trifluorophosphate and mixtures thereof. Preferred are bis(trifluoromethylsulfonyl)imide, tris(trifluoromethyl sulfonyl)methide, tris(pentafluoroethyl)trifluorophosphate and mixtures thereof.

With regard to the lubricant, the non-polar basic oil, the first and the second ionic liquid and in particular with regard to their preferred embodiments, the preceding and the following applies mutatis mutandis.

A further subject matter of the present disclosure is the use of the lubricant composition according to the disclosure for the treatment of surfaces of drive elements, preferably of roller bearings, gears, slide bearings and/or chains, wherein the drive elements are preferably present in plants and machines for the manufacturing and production of food, in wind power plants, in automobiles, in pulley bearings, in rail vehicles, in ships, in electric motors, generators, auxiliary units and/or joints.

A further subject matter of the present disclosure is the use of drive elements, the surfaces of which have been treated with the lubricant composition according to the disclosure, of preferably roller bearings, gears, slide bearings and/or chains, wherein the drive elements are preferably present in plants and machines for the manufacturing and production of food, in wind power plants, in automobiles, in pulley bearings, in rail vehicles, in ships, in electric motors, generators, auxiliary units and/or joints.

In the following, the disclosure is explained in more detail by means of several examples.

Examples I

Preparation of Several Inventive and Comparative Lubricant Compositions in the Form of Lubricating Oils For preparing the compositions according to the disclosure the base oil (copolymer of decene and dec-9-enecarboxylic acid methyl ester) listed in the following Table 1 was employed as the non-polar basic oil, both ionic liquids listed in the table, the second of which has a symmetrical phosphonium cation, were added and the mixture was stirred at 60° C. for 10 min using a magnetic stirrer. After cooling to room temperature, the mixtures were visually examined and the electrical resistance was determined.

For preparing the comparative examples, only one ionic liquid was added to the base oil, but otherwise the same procedure was followed. The base oil without IL was measured without further treatment.

TABLE 1

| Example | P8888bta [%] (insoluble in PAO, second IL) | P66614dehp [%] (soluble in PAO, first IL) | ARIA WTP 40 © [%] non-polar base oil | specific resistance [Mohm*cm]# | appearance |
|---|---|---|---|---|---|
| Example 1 according to the disclosure | 2 | 4 | 94 | 5.40E+01 | slightly turbid |
| Example 2 according to the disclosure | 1 | 2 | 97 | 5.89E+02 | clear |
| Example 3 comparison | 2 | 0 | 98 | 4.20E+03 | turbid |
| Example 4 comparison | 0 | 4 | 98 | 3.80E+03 | clear |
| Example 5 comparison | 0.00 | 0.00 | 100.00 | 1.70E+06 | clear |

#The specification of the specific resistance occurs in an exponential way, i.e. for example, the value 5.40E+01 MOhm*cm means $5.40*10^1$ MOhm*cm.

Table 1 shows that the solubility of the intrinsically insoluble IL P8888bta could be increased by combining both IL, as examples 1 and 2 according to the disclosure show a lower turbidity compared to comparative example 3. In addition, examples 1 and 2 according to the disclosure show a reduced resistance compared to comparative example 3. In addition, example 2 according to the disclosure surprisingly has a lower resistance than comparative example 4, although the content of ionic liquids in example 2 according to the disclosure is lower than in comparative example 4. Comparative examples 4 and 5 are clear because they do not contain any insoluble IL, but they do not solve the problem underlying the disclosure since they have high specific resistances.

Examples II

Preparation of Several Inventive and Comparative Lubricant Compositions in the Form of Lubricating Oils For preparing the compositions according to the disclosure, the base oil (copolymer of decene and dec-9-enecarboxylic acid methyl ester) listed in the following Table 2 was provided as the non-polar basic oil, both ionic liquids listed in the table, the second of which has an asymmetrical ammonium cation, were added and the mixture was stirred at 60° C. for 10 min using a magnetic stirrer. After cooling to room temperature, the mixtures were visually examined and the electrical resistance was determined.

For preparing the comparative examples, only one ionic liquid was added, but otherwise the same method was followed. The base oil without IL was measured without further treatment.

TABLE 2

| Example | N1888 bta [%] second IL, | P66614-dehp [%] first IL | Aria WTP 40 © [%] | specific resistance [Mohm*cm] | appearance |
|---|---|---|---|---|---|
| Example 6 according to the disclosure | 2 | 4 | 94 | 8.02E+02 | slightly turbid |
| Example 7 according to the disclosure | 1 | 2 | 97 | 1.68E+03 | slightly turbid |
| Example 4 comparison | 0 | 4 | 98 | 3.80E+03 | clear |
| Example 8 comparison | 2 | 0 | 98 | 3.48E+04 | turbid |
| Example 5 comparison | 0 | 0 | 100 | 1.70E+06 | clear |

Table 2 shows that the solubility of the intrinsically insoluble IL N18888 bta could be increased by combining both IL, as examples 6 and 7 according to the disclosure show a lower turbidity compared to comparative example 8. In addition, examples 6 and 7 according to the disclosure show a reduced resistance compared to comparative example 8. In addition, example 7 according to the disclosure surprisingly has a lower resistance than comparative example 4, although the content of ionic liquids in example 7 according to the disclosure is lower than in comparative example 4.

Examples III

Preparation of Several Inventive and Comparative Lubricant Compositions in the Form of Lubricating Greases For preparing examples 9 to 13, a base grease was first prepared. The composition was 93.5% Aria WTP 40©

0.5% dioctyldiphenylamine (antioxidant)

6% lithium-12-hydroxystearate.

For this purpose, 30% by weight of the base oil (copolymer of decene and de-9-enecarboxylic acid methyl ester; Aria WTP 40 ©) listed in the following table was submitted as a non-polar basic oil in a vessel with a planetary stirrer. 6% lithium-12-hydroxystearate was added and the mixture was heated to 215° C. while being stirred. The result was a clear melt. The heat supply was stopped and 63.5% by weight of Aria WTP 40 © was added for cooling. At 110° C., 0.5% by weight of dioctyldiphenylamine was added. The mixture was then allowed to cool to room temperature. The resulting base grease was not homogenised.

The two ionic liquids listed in Table 3, both of which have an asymmetrical phosphonium cation, were added to the base grease to prepare the compositions according to the disclosure. The mixtures were mixed with a spatula and homogenised twice via a three-roll mill. To prepare the comparative examples, only one ionic liquid was added, but otherwise the same method was followed. Comparative example 13 without ionic liquids was also homogenised twice via a three-roll mill.

TABLE 3

| Example | P66614bta [%] | P66614dehp [%] | base grease with Aria WTP 40 © as non-polar basic oil [%] | specific resistance [Mohm*cm] |
|---|---|---|---|---|
| Example 9 according to the disclosure | 2 | 4 | 96 | 7.10E+01 |
| Example 10 according to the disclosure | 1 | 2 | 97 | 6.78E+02 |
| Example 11 Comparison | 0 | 4 | 96 | 1.60E+03 |
| Example 12 Comparison | 2 | 0 | 98 | 1.81E+04 |
| Example 13 Comparison | 0 | 0 | 100 | 1.20E+06 |

As can be seen from Table 3, examples 9 and 10 according to the disclosure show a reduced resistance compared to comparative examples 11 to 13. In addition, example 10 according to the disclosure surprisingly has a lower resistance than comparative example 11, although the content of ionic liquids in example 10 according to the disclosure is lower than in comparative example 11.

From this, it can be concluded that results of the oil tests can also be transferred to a grease and are comparable with the measured values of a pure oil formulation with the same raw materials.

Examples IV

Preparation of Several Inventive and Comparative Lubricant Compositions in the Form of Lubricating Oils For preparing compositions according to the disclosure, the base oil listed in the following table, a pure hydrocarbon oil with a very low dipole moment, was submitted as a non-polar basic oil, the two ionic liquids listed in Table 4, which both have an asymmetrical phosphonium cation, were added and the mixture was stirred at 60° C. for 10 min by means of a magnetic stirrer. For preparing the comparative examples, only was ionic liquid was added, but otherwise the same method was followed. The base oil without IL was measured without further treatment.

After cooling down to room temperature, the mixtures were visually examined and the electrical resistance was determined.

TABLE 4

| Examples | P66614-bta [%] second IL | P66614-dehp [%] first IL | basic oil: PAO 6 [%] | specific resistance [Mohm*cm] | appearance |
|---|---|---|---|---|---|
| Example 14 according to the disclosure | 0.67 | 5 | 94.33 | 4.65E+02 | slightly turbid |

TABLE 4-continued

| Examples | P66614-bta [%] second IL | P66614-dehp [%] first IL | basic oil: PAO 6 [%] | specific resistance [Mohm*cm] | appearance |
|---|---|---|---|---|---|
| Example 15 Comparison | 0 | 5 | 95 | 9.99E+02 | clear |
| Example 16 Comparison | 0.67 | 0 | 99.33 | 2.73E+05 | clear |
| Example 17 Comparison | 0 | 0 | 100 | 2.20E+06 | clear |

As can be seen from Table 4, example 14 according to the disclosure shows a reduced resistance compared to comparative examples 15 to 17.

Examples V

Preparation of Several Inventive and Comparative Lubricant Compositions in the Form of Lubricating Oils For preparing the non-polar basic oil, the base oil PAO 6 was mixed with a polar base oil hexane dicarboxylic acid-1,6-diisotridecyl ester at room temperature while being stirred in the weight ratio 80% by weight PAO 6 and 20% by weight hexane dicarboxylic acid-1,6-diisotridecyl ester (CAS number 26401-35-4). Both ionic liquids listed in Table 5, which both have an asymmetric phosphonium cation, were added to the resulting basic oil, and the mixture was stirred at 60° C. for 10 minutes by means of a magnetic stirrer. For preparing the comparative examples, only one ionic liquid was added, but otherwise the same method was followed. After cooling to room temperature, the mixtures were visually examined and the electrical resistance was determined. The basic oil without IL was measured without further treatment.

TABLE 5

| Example | basic oil: PAO 6/hexane dicarboxylic acid-1,6-diisotridecyl ester (weight ratio 80:20) [%] | P66614-dehp [%] first IL | P66614bta [%} second IL | specific resistance [Mohm*cm] | appearance |
|---|---|---|---|---|---|
| Example 18 according to the disclosure | 94 | 4.00 | 2.00 | 1.57E+01 | clear |
| Example 19 according to the disclosure | 95 | 4.00 | 1.00 | 3.87E+01 | clear |
| Example 20 according to the disclosure | 94 | 2.00 | 2.00 | 1.60E+02 | slightly turbid |

TABLE 5-continued

| Example | basic oil: PAO 6/hexane dicarboxylic acid-1,6-diisotridecyl ester (weight ratio 80:20) [%] | P66614-dehp [%] first IL | P66614bta [%} second IL | specific resistance [Mohm*cm] | appearance |
|---|---|---|---|---|---|
| Example 21 according to the disclosure | 97 | 2.00 | 1.00 | 1.14E+02 | clear |
| Example 22 Comparison | 98 | 0.00 | 2.00 | 7.52E+03 | turbid |
| Example 23 Comparison | 99 | 0.00 | 1.00 | 5.62E+03 | turbid |
| Example 24 Comparison | 96 | 4.00 | 0.00 | 1.65E+03 | clear |
| Example 25 Comparison | 98 | 2.00 | 0.00 | 1.18E+04 | clear |
| Example 26 Comparison | 100 | 0.00 | 0.00 | 5.92E+06 | clear |

Table 5 shows that the solubility of the intrinsically insoluble IL P66614bta could be increased by combining both IL, as examples 18 or 21 according to the disclosure show a lower turbidity compared to comparative example 22 or 23. In addition, examples 18 to 21 according to the disclosure show a reduced resistance compared to comparative examples 23 to 26. In addition, example 21 according to the disclosure surprisingly has a lower resistance than comparative example 24, although the content of ionic liquids in example 21 according to the disclosure is lower than in comparative example 24.

Examples VI

Preparation of Several Inventive and Comparative Lubricant Compositions in the Form of Lubricating Oils For preparing the non-polar basic oil, the base oil PAO 6 was mixed with a polar base oil hexane dicarboxylic acid-1,6-diisotridecyl ester at room temperature while being stirred in the weight ratio 70% by weight PAO 6 and 30% by weight hexane dicarboxylic acid-1,6-diisotridecyl ester (CAS number 26401-35-4). Both ionic liquids listed in Table 6, which both have an asymmetric phosphonium cation, were added to the resulting basic oil, and the mixture was stirred at 60° C. for 10 minutes by means of a magnetic stirrer. For preparing the comparative examples, only one ionic liquid was added, but otherwise the same method was followed. After cooling to room temperature, the mixtures were visually examined and the electrical resistance was determined. The basic oil without IL was measured without further treatment.

TABLE 6

| Example | base oil: PAO 6/hexane acid-1,6-diisotridecyl ester in a weight ratio of 70:30 | P66614-dehp di-carboxylic first IL | P66614-bta [%] second IL | specific [%] [Mohm*cm] | appearance resistance |
|---|---|---|---|---|---|
| Example 26 according to the disclosure | 94.00 | 4 | 2 | 1.05E+01 | clear |
| Example 27 according to the disclosure | 96.00 | 2 | 2 | 2.24E+01 | clear |
| Example 28 according to the disclosure | 95.00 | 4 | 1 | 3.29E+01 | clear |
| Example 29 according to the disclosure | 97.00 | 2 | 1 | 6.62E+01 | clear |
| Example 30 Comparison | 98.00 | 0 | 2 | 9.30E+02 | turbid |
| Example 31 Comparison | 96.00 | 4 | 0 | 1.28E+03 | clear |
| Example 32 Comparison | 98.00 | 2 | 0 | 7.60E+03 | clear |
| Example 33 Comparison | 100 | 0 | 0 | 4.50E+06 | clear |

Table 6 shows that the solubility of the intrinsically insoluble IL P66614bta could be increased by combining both IL, since examples 27 and 26 according to the disclosure show a lower turbidity compared to comparative example 30. In addition, examples 26 to 29 according to the disclosure show a reduced resistance compared to comparative examples 30 to 33. In addition, example 29 according to the disclosure surprisingly has a lower resistance than comparative example 31, although the content of ionic liquids in example 29 according to the disclosure is lower than in comparative example 31.

Examples VII

Preparation of Several Inventive and Comparative Lubricant Compositions in the Form of Lubricating Oils For preparing the compositions according to the disclosure, the base oil (copolymer of decene and dec-9-enecarboxylic acid methyl ester) listed in the following Table 7 was provided as the non-polar basic oil, both ionic liquids listed in the table, which both have an asymmetrical phosphonium cation, were added and the mixture was stirred at 60° C. for 10 min using a magnetic stirrer. After cooling to room temperature, the mixtures were visually examined and the electrical resistance was determined.

For preparing the comparative examples, only one ionic liquid was added, but otherwise the same method was followed. The base oil without IL was measured without further treatment.

TABLE 7

| Example | P66614 dehp first IL [%] | P66614 bta second IL [%] | Aria WTP 40 © [%] | spec. resistance [Mohm* cm] | Appearance | Kinematic viscosity 40° C. | Kinematic viscosity at 100° C. | VI |
|---|---|---|---|---|---|---|---|---|
| Example 34 according to the disclosure | 1.00 | 1.00 | 98.00 | 1.11E+03 | clear | 346.1 | 39.12 | 164 |
| Example 35 according to the disclosure | 1.50 | 0.50 | 98.00 | 2.50E+03 | clear | 348.7 | 35.91 | 165 |
| Example 37 Comparison | 0.00 | 2.00 | 98.00 | 1.09E+04 | turbid | — | — | — |
| Example 38 Comparison | 2.00 | 0.00 | 98.00 | 3.00E+04 | clear | 348.1 | 39.36 | 164 |

VI = viscosity index

As can be seen from Table 7, all considered compositions have a total ionic liquid content of 2% by weight. By combining the two ILs in both a weight ratio of 1:1 in example 34 according to the disclosure and 1.5:1 in example 35 according to the disclosure, a lower resistance could be obtained than in the two comparative examples 37 and 38, which only contain one ionic liquid. However, the kinematic viscosity changes only slightly, there is no influence of the viscosity on the observed differences in electrical resistance.

Examples VIII

Preparation of Several Inventive and Comparative Lubricant Compositions in the Form of Lubricating Oils For preparing the non-polar basic oil, the base oil PAO 6 was mixed with the polar base oil hexane dicarboxylic acid-1,6-diisotridecyl ester at room temperature while being stirred in the weight ratio 50% by weight PAO 6 and 50% by weight hexane dicarboxylic acid-1,6-diisotridecyl ester (CAS number 26401-35-4), both ionic liquids listed in the table, which both have an asymmetric phosphonium cation, were added, and the mixture was stirred at 60° C. for 10 minutes by means of a magnetic stirrer. After cooling to room temperature, the mixtures were visually examined and the electrical resistance was determined. For preparing the comparative examples, only one ionic liquid was added, but otherwise the same method was followed. The base oil without IL was measured without further treatment.

TABLE 8

| Example | basic oil: PAO 6/ hexane dicarboxylic acid-1,6-diisotridecyl ester in a weight ratio of 50:50 [%] | P66614dehp [%] first IL | P66614 bta [%] second IL | specific resistance [Mohm* cm] | Appearance | Kinematic viscosity at 40° C. | Kinematic viscosity at 100° C. | VI |
|---|---|---|---|---|---|---|---|---|
| Example 39 according to the disclosure | 96.00 | 2.00 | 2.00 | 1.09E+01 | clear | 29.36 | 5.73 | 140 |
| Example 40 according to the disclosure | 95.00 | 4.00 | 1.00 | 1.85E+01 | clear | 29.38 | 5.74 | 141 |
| Example 41 according to the disclosure | 97.00 | 2.00 | 1.00 | 3.43E+01 | clear | 28.54 | 5.62 | 140 |
| Example 42 Comparison | 99.00 | 0.00 | 1.00 | 1.31E+02 | clear | 27.74 | 5.51 | 140 |
| Example 43 Comparison | 96.00 | 4.00 | 0.00 | 8.54 + 02 | clear | 29.05 | 5.67 | 140 |
| Example 44 Comparison | 98.00 | 2.00 | 0.00 | 2.93E+03 | clear | 27.93 | 5.54 | 140 |
| Example 45 Comparison | 100.00 | 0.00 | 0.00 | 7.92 + 05 | clear | 27.23 | 5.48 | 140 |

VI = viscosity index

As can be seen from Table 8, examples 39 and 41 according to the disclosure show a reduced resistance compared to all comparative examples 42 to 45. In addition, example 41 according to the disclosure surprisingly has a lower resistance than comparative example 43, although the content of ionic liquids in example 41 according to the disclosure is lower than in comparative example 43. Examples 39 and 40 according to the disclosure have the highest kinematic viscosity at 40° C. and the lowest specific resistance of all examples 39 to 45. Thus, the observed differences in the specific resistances are not due to changes in the kinematic viscosity.

Examples IX

Preparation of Several Inventive and Comparative Lubricant Compositions in the Form of Lubricating Oils For preparing the compositions according to the disclosure, the base oil (copolymer of decene and dec-9-enecarboxylic acid methyl ester) listed in the following Table 9 was submitted as the non-polar basic oil, both ionic liquids listed in the table, which both have an asymmetrical phosphonium cation, were added and the mixture was stirred at 60° C. for 10 min using a magnetic stirrer. After cooling to room temperature, the mixtures were visually examined and the electrical resistance was determined.

For preparing the comparative examples, only one ionic liquid was added, but otherwise the same method was followed. The base oil without IL was measured without further treatment.

TABLE 9

| Example | P66614-fsi [%] second IL | P66614-dehp [%] first IL | Aria WTP 40 © [%] | specific resistance [Mohm*cm] | appearance |
|---|---|---|---|---|---|
| Example 46 according to the disclosure | 2 | 4 | 94 | 1.76E+02 | turbid |
| Example 47 according to the disclosure | 1 | 2 | 97 | 5.04E+02 | clear |
| Example 48 Comparison | 0 | 4 | 96 | 3.80E+03 | clear |
| Example 49 Comparison | 2 | 0 | 98 | 3.39E+04 | turbid |
| Example 5 Comparison | 0 | 0 | 100 | 1.70E+06 | clear |

As can be seen from Table 9, examples 46 and 47 according to the disclosure show a reduced resistance compared to all comparative examples 5, 48 and 49. In addition, example 47 according to the disclosure surprisingly has a lower resistance than comparative example 48, although the content of ionic liquids in example 47 according to the disclosure is lower than in comparative example 48.

Testing Methods

Unless otherwise specified, the described standards refer to the version valid at the time of application.

Determination of the Solubility of the Ionic Liquids in Polyalphaolefin

An ionic liquid is soluble in polyalphaolefin, in particular in PAO 400/40 prepared from 1-decene as a monomer component, if, when measuring turbidity according to DIN EN ISO 7027 at 25° C. of a mixture of 1% by weight of the ionic liquid and 99% by weight polyalphaolefin, in particular PAO 400/40 prepared from 1-decene as a monomer component, the turbidity value is not more than 1 FNU higher than is the case with pure polyalphaolefin, in particular PAO 400/40 prepared from 1-decene as a monomer component.

An ionic liquid is insoluble in polyalphaolefin, in particular in PAO 400/40 prepared from 1-decene as a monomer component, if, when measuring turbidity according to DIN EN ISO 7027 at 25° C. of a mixture of 1% by weight of the ionic liquid and 99% by weight polyalphaolefin, in particular PAO 400/40 prepared from 1-decene as a monomer component, the turbidity value is more than 1 FNU higher than is the case with pure polyalphaolefin, in particular PAO 400/40 prepared from 1-decene as a monomer component.

A 2100 AN IS by Hach is used as the measuring instrument. PAO 400/40 is a polyalphaolefin with a kinematic viscosity (average) of 400 $mm^2$/sec at 40° C. The FNU value is below 0.2.

The ionic liquids are added to PAO 400/40, heated to 100° C. on the magnetic stirrer while being stirred, then the resulting mixture is poured into the measuring cuvettes and measured after cooling down to 25° C. Synton PAO 40, prepared from 1-decene, was used as PAO 400/40, wherein the kinematic viscosity at 40° C. measured according to ASTM D-445 was between 38 and 42 $mm^2$/sec.

Evaluation of the Appearance of Lubricant Compositions

To evaluate the appearance, the lubricant compositions in the form of lubricating oils are carefully poured into transparent, cylindrical glass screw-cap containers 12 cm high and 1.25 cm in radius and left to stand for two hours without moving. The glasses, which are filled with lubricant compositions containing IL, are compared with the glass containing the corresponding non-polar basic oil without IL. If optical observation of the two samples parallel to the bottom of the container reveals a difference, the sample is classified as slightly turbid or turbid.

Determination of the Specific Resistance of Lubricating Oils in Accordance with DIN 51412-1 in the Version of August 1979

For the determination, a high ohmic liquid electrode FSE 3 (Fischer Elektronik, 15749 Mittenwalde, Germany) is used, and a Milli-TO 3 (Fischer Elektronik, 15749 Mittenwalde, Germany) as a voltage source. An average value is calculated over three individual measurements. The measuring voltage is 10 V direct current. A measured value is read one minute after applying the measuring voltage. If no measured values can be obtained at 10 V measuring voltage, the measuring voltage is increased to 100 V and then the method is followed analogously. This is typically required for samples with high specific resistance (>1E4 Mohm*cm).

Determination of the Specific Resistance of Lubricating Greases in Accordance with DIN 53482 May 1983 Version)

For this purpose, a circular plate electrode according to 5.3, FIG. 2 of the mentioned DIN standard is modified with a 1 mm thick PTFE ring between electrode 2 and the guide piece 4 whereby a cylindrical cavity is created between electrode 1 (measuring electrode) and electrode 2) (counter electrode) with a height of 1 mm and an area of 20 $mm^2$. The cell constant is thus 200. The measured value [Ohm] must be multiplied by this to obtain the specific resistance. With a spatula the lubricating grease is inserted into the cavity described above and placed on the electrode 1. The measuring cell composed in this way is introduced into a shielding chamber (TOM 300-2, Fischer Elektronik, 15749 Mittenwalde, Germany). A Milli-TO 3 (Fischer Elektronik, 15749 Mittenwalde, Germany) is used as a voltage source. A DC voltage of 10 V is applied and the measured value [in Ohm] is read after 1 minute. The measurement is repeated three times, wherein new grease is applied to the cavity each time. The average value over the three individual measurements is multiplied by the cell constant and the specific resistance is thus obtained. If necessary, the measuring voltage can be increased as described above.

Determining the Kinematic Viscosity at 40° C., at 100° C. and the Viscosity Index (VI)

Unless otherwise specified, the determination is carried out with a Stabinger viscometer according to ASTM D7042, July 2016 edition.

Determining the Polarity of the Basic Oil

The polarity of a basic oil was determined according to the disclosure by the dipole moment. For this purpose, the dipole moments were calculated according to Trib. Int. 43, 2010, 2268-2278, The influence of base oil polarity on the tribological performance of zinc dialkyl dithiophosphate, A. N. Suarez et. Al. For this, the programme Hyperchem was used. In the first step, the rough structure of the molecule was calculated by means of force field calculation ("Molecular Mechanics Force Field" with BIO+(CHARMM)", then the semi-empirical model ("semi-empirical method") with the selection "RM1" was applied. Optimisations were run until convergence occurred (RMS gradient less than 0.01 kcal/Å mol). For basic oils that represent oligomeric mixtures, such as polyalphaolefins, published lead structures were used for the calculation, (Exxon Mobil Chemical, in Researchgate, Harrington, B. A. & Reid-Peters, S. & Han, W. W. (2014). The influence of molecular structure on the properties of polyalphaolefins (PAO). 61. 14-18). If the basic oil is composed of different base oils, the dipole moment was summed up by the mass proportions of the individual base oils multiplied by the dipole moment calculated for the individual base oil.

The following table shows some results by way of example.

| Base oil or basic oil | calculated dipole moment [D] |
|---|---|
| PAO 400 | 0.13 |
| Pyromellitic acid tetra(2-ethylhexanoate) | 3.35 |
| Trimellitic acid didecyl octyl ester | 3.42 |
| PAO 6 | 0.09 |
| Alkylated diphenyl ether (viscosity 100 cst at 40° C.) | 1.21 |
| Pyromellitic acid tetra(2-ethylhexanoate)/alkylated diphenyl ether (weight ratio 1:1) | 2.28 |
| Aria WTP 40 © | 1.82 |
| Hexane-1,6-dicarboxylic acid diisotridecyl ester | 4.79 |
| PAO 6/hexane-1,6-dicarboxylic acid diisotridecyl ester (weight ratio 8:2) | 1.03 |
| PAO 6/hexane-1,6-dicarboxylic diisotridecyl ester (weight ratio 7:3) | 1.50 |
| PAO 6/hexane-1,6-dicarboxylic acid diisotridecyl ester (weight ratio 1:1) | 2.44 |

In accordance with the disclosure, a non-polar basic oil is understood as a basic oil with a dipole moment as calculated above of at most 3.00 D.

The invention claimed is:

1. A lubricant composition comprising a) a lubricant comprising a non-polar basic oil, b) a first ionic liquid which is soluble in polyalphaolefin (PAO) comprising anions selected from the group consisting of dialkyl phosphate, dialkyl phosphinate, carboxylate, docusate and mixtures thereof, c) a second ionic liquid which is insoluble in polyalphaolefin (PAO) comprising anions selected from the group consisting of bis(perfluoroalkylsulfonyl)imides, tris (perfluoroalkylsulfonyl)methides, tris(perfluoroalkyl) trifluorophosphates, bis(fluorosulfonyl)imide and mixtures thereof.

2. The lubricant composition according to claim 1, characterised in that the first ionic liquid is soluble in the lubricant and the second ionic liquid is insoluble in the lubricant.

3. The lubricant composition according to claim 1, characterised in that the lubricant comprises a first basic oil selected from the group consisting of mineral oils, PAO, diphenyl ethers and mixtures thereof in combination with a second basic oil, selected from the group consisting of native and synthetic esters, polyglycols and mixtures thereof.

4. The lubricant composition according to claim 3, characterised in that the weight ratio of the first basic oil to the second basic oil is 90:10 to 50:50.

5. The lubricant composition according to claim 1, characterised in that the lubricant contains a non-polar basic oil selected from the group consisting of mineral oils, polyalphaolefins, alkylated naphthalenes, alkylated diphenyl ethers, alkylated benzenes, copolymers of alkenes.

6. The lubricant composition according to claim 1, characterised in that the lubricant contains a non-polar basic oil selected from the group consisting of mineral oils, polyalphaolefins, alkylated naphthalenes, alkylated diphenyl ethers, alkylated benzenes, copolymers of alkenes, and mixtures thereof, in a mixture with other basic oils comprising one or more polar base oils, wherein the non-polar basic oil is in a proportion of more than 50% by weight, based on the total weight of the basic oil.

7. The lubricant composition according to claim 1, characterised in that the lubricant contains a basic oil comprising copolymers of alkenes.

8. The lubricant composition according to claim 1, characterised in that the first and second ionic liquid independently of one another contain cations selected from the group containing symmetrical and asymmetrical ammonium ions, $NR_1R_2R_3R_4^+$ and phosphonium ions $PR_1R_2R_3R_4^+$, wherein the radicals $R_1$ to $R_4$ are each independently of one another branched or unbranched, substituted or unsubstituted $C_1$ to $C_{24}$ alkyl groups.

9. The lubricant composition according to claim 1, characterised in that the first ionic liquid is selected from the group consisting of (trihexyltetradecylphosphonium) bis(2-ethylhexylphosphate)

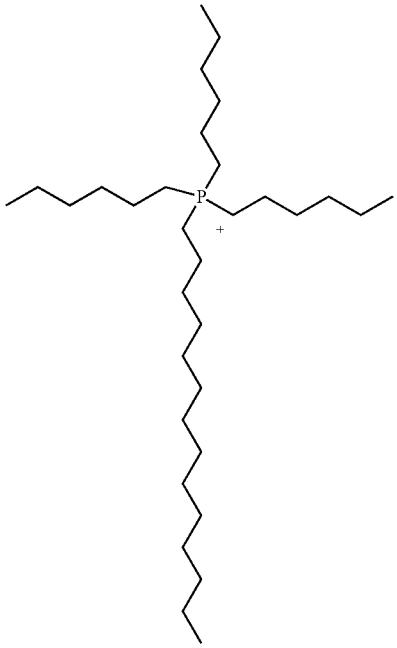

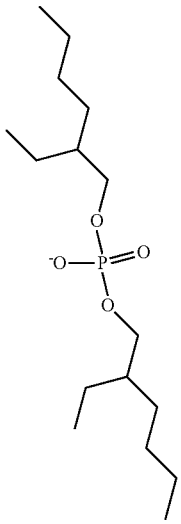

(trihexyltetradecylphosphonium) docusate

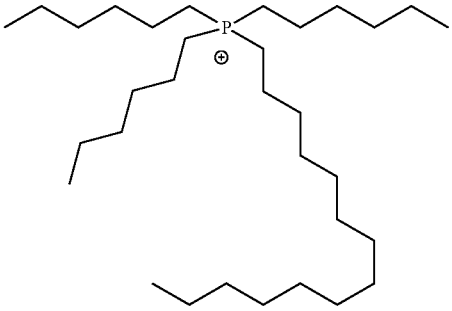

-continued

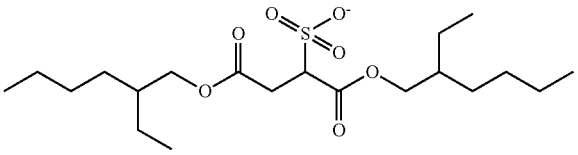

(trihexyltetradecylphosphonium) bis(2,4,4-trimethylpentyl)phosphinate

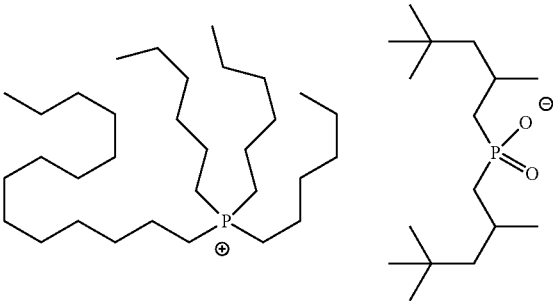

(trihexyltetradecylphosphonium) decanoate

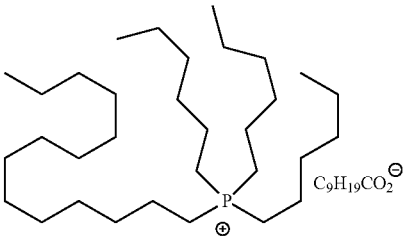

and mixtures thereof.

10. The lubricant composition according to claim 1, characterised in that the second ionic liquid is selected from the group consisting of (trihexyltetradecylphosphonium) bis(trifluormethylsulfonyl)imide

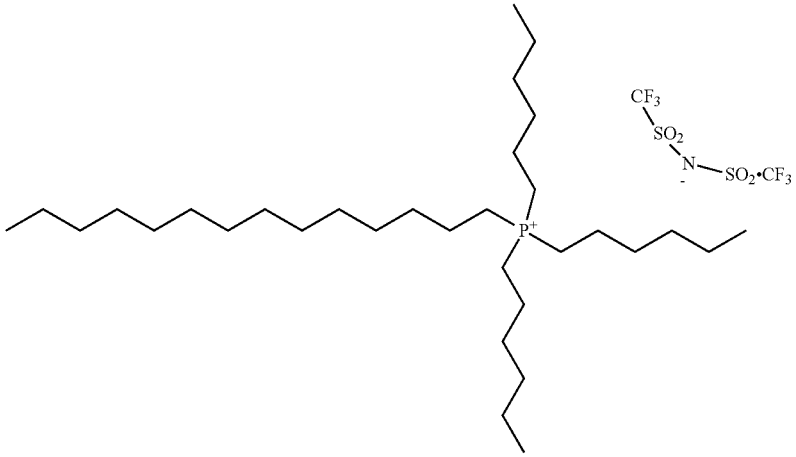
(tetraoctylphosphonium) bis(trifluormethylsulfonyl) imide
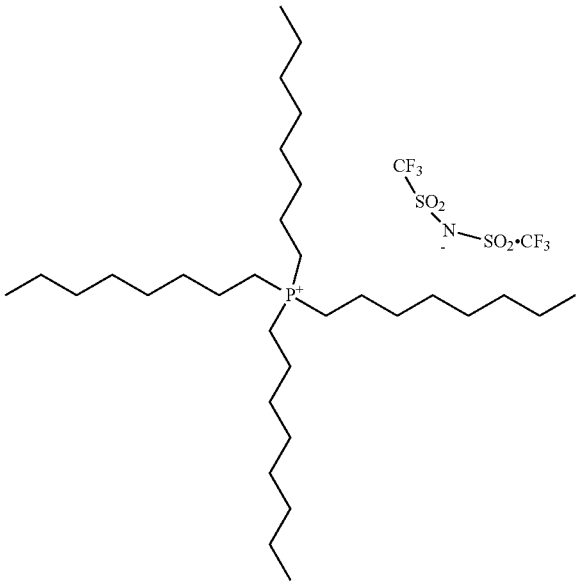
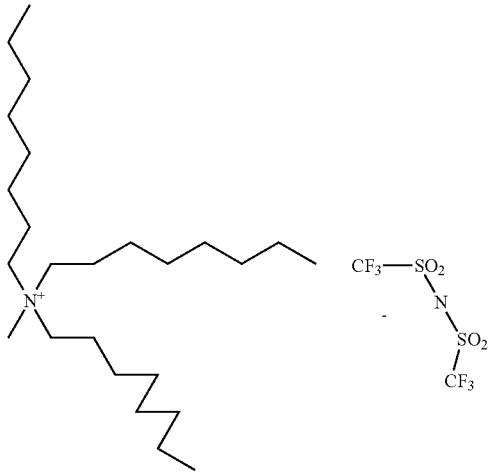
(methyltrioctylammonium) bis(trifluormethylsulfonyl) imide
trihexyltetradecylphosphonium bis(fluorsulfonyl)imide
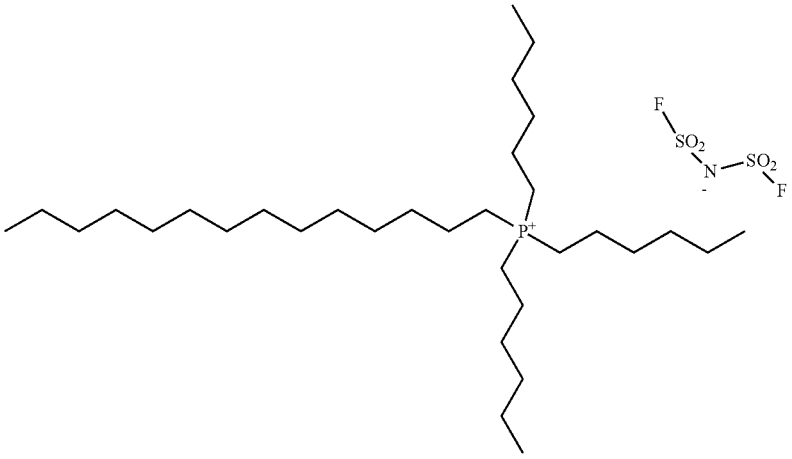
and mixtures thereof.

11. The lubricant composition according to claim 1, characterised in that the lubricant composition comprises: (trihexyltetradecylphosphonium) bis(2-ethylhexylphosphate) as the first ionic liquid and (tetraoctylphosphonium) bis(trifluormethylsulfonyl)imide as the second ionic liquid; or (trihexyltetradecylphosphonium) bis(2-ethylhexylphosphate) as the first ionic liquid and (trihexyltetradecylphosphonium) bis(trifluormethylsulfonyl)imide as the second ionic liquid; or trihexyltetradecylphosphonium) bis(2-ethylhexylphosphate) as the first ionic liquid and (trihexyltetradecylphosphonium) bis(fluorosulfonyl)imide as the second ionic liquid.

12. The lubricant composition according to claim 1, characterised in that a proportion of the first ionic liquid, based on the total weight of the lubricant composition, is 0.5 to 10% by weight, and the proportion of the second ionic liquid, based on the total weight of the lubricant composition, is 0.25 to 5% by weight.

13. The lubricant composition according to claim 1, characterised in that the weight ratio of the first ionic liquid to the second ionic liquid is 1:1 to 4:1.

14. A lubricant composition comprising a) a lubricant containing a basic oil selected from the group consisting of mineral oils, polyalphaolefins, alkylated naphthalenes, alkylated diphenyl ethers, alkylated benzenes, and copolymers of alkenes, b) a first ionic liquid whose anion is selected from the group consisting of dialkyl phosphate, dialkylphosphinate, carboxylate, docusate and mixtures thereof, c) a second ionic liquid whose anion is selected from the group consisting of bis(perfluorosulfonyl)imide, tris(perfluoroalkylsulfonyl)methide, tris(perfluoroalkyl) trifluorophosphate, bisfluorosulfonylimide and mixtures thereof.

15. A method of operating an apparatus having a drive element, the method comprising supplying to the surface of the drive element a lubricant composition as defined in any of claims 1 to 14.

16. The method according to claim 15, wherein the drive element is being selected from roller bearings, gears, slide bearings and/or chains.

17. The method according to claim 15, wherein the drive elements are present in plants and machines for manufacturing and producing food, in wind power plants, in automobiles, in pulley bearings, in rail vehicles, in ships, in electric motors, generators, auxiliary units and/or joints.

* * * * *